United States Patent [19]

Lemon et al.

[11] Patent Number: 5,027,890

[45] Date of Patent: Jul. 2, 1991

[54] FOUNDRY MOULDING COMPOSITION

[75] Inventors: Peter H. R. B. Lemon, Romsey; Jeffrey D. Railton, Shirley Warren; Derek W. Baker, Hedge End; John Ireland, Woolston, all of England

[73] Assignee: Borden (UK) Limited, London, United Kingdom

[21] Appl. No.: 593,748

[22] Filed: Oct. 5, 1990

Related U.S. Application Data

[62] Division of Ser. No. 295,520, Jan. 11, 1989, Pat. No. 4,980,394.

[51] Int. Cl.[5] ..... B22C 1/22

[52] U.S. Cl. ..... 164/526; 164/16

[58] Field of Search ..... 164/16, 526, 527

[56] References Cited

U.S. PATENT DOCUMENTS

| | | | |
|---|---|---|---|
| 4,283,319 | 8/1981 | Konii et al. | 523/145 |
| 4,468,359 | 8/1984 | Lemon et al. | 523/145 |
| 4,474,904 | 10/1984 | Lemon et al. | 523/146 |

OTHER PUBLICATIONS

Stanbridge et al., "The Replacement of Seacoal in Iron Foundry Molding Sands"; (AFS Trans.), 82, 169–180 (1974).

Owen et al., "Coaldust Replacement as a Greens a Additive" (British Foundryman), 29–32 (Feb. 1975).

*Primary Examiner*—Kuang Y. Lin

*Attorney, Agent, or Firm*—Venable, Baetjer, Howard & Civiletti

[57] ABSTRACT

The invention relates to foundary moulding compositions useful for producing moulds for the manufacture of metal castings wherein the moulds are capable of giving castings with good surface finish without the need for conventional separate blacking applications. A foundary moulding composition of the invention comprises refractory material such as sand, alkali phenol-formaldehyde resole resin solution, carbonifiable material such as styrenated phenol, and an effective amount of an organic ester for hardening the composition. In another embodiment, the invention is a binder composition comprising alkali phenol-formaldehyde resole resin solution and carbonifiable material capable of being hardened by reaction with organic ester. In another embodiment, the invention is a curing additive for a foundry binder comprising carbonifiable material and liquid ester such as gamma-butyrolactone, and the like. In another embodiment, the invention is a method of making a foundry mould wherein a mixture of sand, resin and carbonifiable material is shaped, and then hardened with a gaseous ester such as methyl formate.

12 Claims, No Drawings

FOUNDARY MOULDING COMPOSITION

This is a division, of application U.S. Ser. No. 07/295,520, filed 1/11/89, now U.S. Pat. No. 4,980,394.

BACKGROUND

The present invention relates to foundry moulding compositions useful for the production of moulds or cores required for the manufacture of metal castings. More particularly, the invention relates to compositions useful for producing foundry moulds or cores which, without the need of separate blacking applications, are capable of giving castings of good surface finish.

Conventionally, in the production of metal castings, particularly in the case of castings of grey and nodular irons, aluminum and low melting point alloys such as bronze and brass from moulds formed from cold set resin bonded sand, the surface finish of the castings is improved by applying to the surfaces of the moulds and/or cores a wash known as a blacking prior to casting. Such washes commonly comprise a suspension of carbon or graphite in a liquid carrier such as water or a low boiling organic solvent, for example isopropanol. After application, the carrier is evaporated or, if a flammable liquid is used, may be ignited.

There is some dispute as to the precise mechanism of the action of such washes, and their action may involve a number of different effects. It is, however, generally believed that the solid particles contained in the washes acts in a mechanical way by filling the voids and cracks in the mould or core surface. The carbon present in the wash or produced by the action of the hot metal during the casting operation may serve as a release agent by creating a barrier between the mould wall and the solidifying metal. It has also been suggested that the wash serves to release gas to form a gas cushion between the mould walls and the molten metal. A general discussion of these effects can be found in Trans. AFS, Vol. 82, pages 169–180 (1974). However, whatever mechanism, or combination of mechanisms, is followed, such washes are found to improve the surface finish of castings made from moulds produced from many types of binder.

The need to apply blacking washes is, however, a disadvantage. Firstly, it involves a separate, often very time-consuming step, which adds additional labor cost to the production of castings. Secondly, the blacking washes are difficult to apply uniformly to the surfaces of the moulds and cores, especially in the case of complex mould and core shapes. Consequently, their efficiency will vary from mould to mould and from point to point within a mould. It is a further disadvantage when a flammable carrier solvent is used in that not only does this involve an additional material cost but it also results in the production of fumes which may consequently reduce the quality of the working environment, as well as constituting a flammability hazard requiring special storage conditions and subsequent caution during use.

SUMMARY OF THE INVENTION

The object of the present invention is to provide the means for obtaining castings of excellent surface quality without the need for separate applications of blacking washes to the foundry mould or core surfaces prior to casting. We have found that this can be achieved by incorporating into the foundry moulding composition used to make the foundry moulds or cores a carbonifiable material which evolves a large amount of carbon at metal casting temperatures.

According to a first aspect, the present invention provides a hardenable foundry binder composition capable of being hardened by reaction with an organic ester. The binder comprises an aqueous solution of a potassium or sodium alkali phenol-formaldehyde resole, or a mixture thereof, resin having a formaldehyde:phenol molar ratio of from 1.2:1 to 2.6:1 and an alkali:phenol molar ratio in the range of from 0.2:1 to 1.2:1. The aqueous solution of resole resin has a solids content of from 25% to 75% by weight and a viscosity in the range of from 20 cP to 1000 cP at 25° C. The composition also comprises a carbonifiable material capable of evolving at least 20% lustrous carbon, as hereinafter defined.

According to a second aspect, the present invention provides a hardenable foundry moulding composition capable of being hardened by reaction with an organic ester comprising a mixture of:

(a) a granular refractory composition;

(b) from 0.25% to 8% by weight, and preferably 0.5% to 2.5%, based on the weight of the granular refractory material of an aqueous solution having a solids content of from 25% to 75% by weight of a potassium or sodium alkali phenol-formaldehyde resole resin, or mixture thereof, having a formaldehyde:phenol molar ratio in the range of from 1.2:1 to 2.6:1 and an alkali:phenol molar ratio in the range of from 0.2:1 to 1.2:1. The aqueous solution of resole resin has a viscosity in the range of from 20 cP to 1000 cP at 25° C., and (c) a carbonifiable material capable of evolving at least 20% lustrous carbon, as hereinafter defined.

A hardenable foundry moulding composition according to the second aspect of the invention above is caused to harden by reaction with an organic ester. The organic ester may be a liquid ester which is incorporated into the composition by mixing with the other components of the composition, or it may be a 1–3 carbon alkyl formate which is applied to the hardenable foundry moulding composition by gassing, with the formate dispersed in a carrier gas as a vapor, or as an aerosol.

Thus, the invention further provides a foundry moulding composition comprising of a mixture of:

(a) a granular refractory material;

(b) from 0.25% to 8% by weight, and preferably 0.5% to 2.5%, based on the weight of the granular refractory material of an aqueous solution having a solids content of 25% to 75% by weight of a potassium or sodium alkali phenol-formaldehyde resole resin, or a mixture thereof, having a formaldehyde:phenol molar ratio in the range of from 1.2:1 to 2.6:1 and an alkali:phenol molar ratio in the range of from 0.2:1 to 1.2:1, said aqueous solution of resole resin having a viscosity in the range of from 20 cP to 1000 cP at 25° C.;

(c) an amount effective to catalyze the curing of the resin of at least one liquid organic ester, and (d) a carbonifiable material capable of evolving at least 20% lustrous carbon, as hereinafter defined.

The invention further provides a method of making foundry moulds or cores which comprises forming the foundry moulding composition comprising the mixture of the granular refractory material, the aqueous resole resin solution, the liquid ester and the carbonifiable material into the desired shape, and allowing the mixture to set by the curing of the resin by reaction with the ester.

As mentioned above, as an alternative to incorporating a liquid organic ester into the composition to harden the phenolic resin, a foundry moulding composition comprising a mixture of the granular refractory material, the aqueous solution of the phenolic resole resin and the carbonifiable material can be hardened by gassing according to known techniques with a 1–3 carbon alkyl formate, i.e., methyl, ethyl, propyl, or isopropyl formate.

DETAILS OF THE INVENTION

Thus, the present invention further provides a method of making a foundry mould or core comprising the steps of mixing (a) a granular refractory material;

(b) from 0.25% to 8% by weight, and preferably 0.5% to 2.5%, based on the weight of the granular refractory material of an aqueous solution having a solids content of from 25% to 75% by weight of a potassium or sodium alkali phenol-formaldehyde resole resin, or mixture thereof, having a formaldehyde:phenol molar ratio in the range of from 1.2:1 to 2.6:1 and an alkali:phenol molar ratio in the range of from 0.2:1 to 1.2:1, said aqueous solution of resole resin having a viscosity in the range of from 20 cP to 1000 cP at 25° C., and (c) a carbonifiable material capable of evolving at least 20% lustrous carbon, as hereinafter defined, and then forming the mixture into the desired shape and then curing the resole resin in the mixture by gassing it with a 1–3 carbon alkyl formate, that is dispersed in a carrier gas as a vapor or as an aerosol.

Although many different types of carbonifiable material can be reduced to carbon by pyrolysis at metal casting temperatures, we have found that in order to be effective in the present invention in eliminating the conventional need for blacking washes, the carbonifiable material used in the present invention should be one that is capable of evolving at least 20% lustrous carbon.

The amount of lustrous carbon evolved by a carbonifiable material may be determined in accordance with the method described by I. Bindernagel et al., Giesserei, Vol. 51, pages 729–730 (1964). This method, hereafter called "the Bindernagel test", uses a quartz tube, sealed at one end, filled with glass wool and with an elbow at 16° from the horizontal, fitted with a ground glass socket joint terminating in a crucible. Before every determination, the quartz crucible and the quartz tube are heated for about 15 minutes in air, cooled in a desiccator, and accurately weighed to 0.1 mg. The quartz tube, together with its support, is placed in a muffle furnace preheated to 875 C.. When the temperature has stabilized, the quartz crucible containing 0.5 g of air dried carbonifiable material is filled quickly into the tube in the furnace. The temperature loss should be kept to a minimum while doing this. The heating of the oven must be controlled so that the nominal temperature is reestablished after 3–4 minutes. Lustrous carbon formation is complete after holding for 3 minutes at the nominal temperature.

The crucible and tube are then cooled in a desiccator for 30 minutes. The tube containing the lustrous carbon is then reweighed accurately to 0.1 mg. The percentage yield of lustrous carbon evolved from the sample of carbonifiable material is given by the following expression:

$\%\ \text{lustrous carbon} = [(A-B)/(C-D)] \times 100\%$ where

A = final weight of the quartz tube after test (g);

B = weight of quartz tube before test (g);

C = weight of air-dried sample of carbonifiable material used (g), and

D = moisture content of sample (g).

The carbonifiable material used in the various aspects and embodiments of the present invention will comprise one or more organic compounds capable of evolving at least 20% lustrous carbon, as described above. Because carbonization in moulds and cores produced according to the invention is effected only at the time the hot metal contacts the mould or core walls during the casting process, and because the moulds and cores may be stored for extended periods before they are used, it is greatly preferred that the carbonifiable material used in the invention have low volatility or be non-volatile in order that any substantial loss of the carbonifiable material by evaporation prior to use of the mould or core does not occur.

We have found the most effective carbonifiable materials for use in the present invention to be hydrocarbons having a high carbon to hydrogen ratio, particularly, for example, those having or including an aromatic structure. Examples of preferred carbonifiable materials that can be used in the present invention include naphthalene, anthracene, phenanthrene, pyrene, diphenyl, polystyrene and styrenated phenol. Typically, the carbonifiable material will be used in an amount in the range of from 0.5% to 165% by weight based on the weight of the resin solution. Used in amounts less than 0.5% by weight of the resin solution, the carbonifiable material gives rise to a negligible improvement in the surface finish of the eventual casting. If the carbonifiable material is used in too great an amount, i.e., above 165% by weight of the resin solution, there is a risk that the resulting casting will show surface defects arising from an excess of carbon being present at the mould surface. Of course, the optimum amount of carbonifiable material used in any particular case will be, at least, partly dependent on the amount of lustrous carbon that is evolved by the carbonifiable material used. According to a preferred embodiment of the invention, we have found that the use of styrenated phenol in an amount of from 10% to 30% by weight based on the weight of the resin solution gives excellent results.

The granular refractory materials useful in the present invention may be any of the refractory materials commonly employed for the production of moulds and cores. Examples include silica sand, quartz, chromite sand, zircon or olivine sand. The compositions of the invention have the particular advantage that the difficulties commonly associated with the bonding of sands of alkaline reaction, such as olivine and chromite, or beach sands containing shell fragments, and which arise from neutralization or partial neutralization of the acid catalyst used in acid catalyzed binder systems, are completely overcome since in the present invention, the resin binder is cured under alkaline conditions.

The nature of the phenol-formaldehyde resole resin used in the various aspects and embodiments of the invention is an important feature of the present invention. Since the present invention is directed to cold set techniques, the resin binder will be used as an aqueous solution of the resin. The solids content of the aqueous solution of the resin used in the present invention will be in the range of from 25% to 75% by weight. Resin solutions having a solids content of less than 25% by weight are not considered useful in the present invention since the large water content reduces the effectiveness of the binder. Solids contents greater than 75% by weight, however, are not used since resin solutions having such solids content generally are too viscous.

The degree of condensation of the phenolic resin may be described by reference to the solids content and the viscosity of the aqueous solution of the resin. According to the present invention, the aqueous resin solution will have a viscosity in the range of from 20 cP to 1000 cP at 25° C. The preferred resin solutions for use in the invention will have a solids content of about 60% by weight and solution viscosity of about 200 cP.

The phenol-formaldehyde resole resins used in the various aspects and embodiments of the present invention are potassium- or sodium-catalyzed phenol-formaldehyde resole resins, or mixtures of these. We prefer to use KOH catalyzed resins since these tend to give better strength increase with time compared to NaOH catalyzed resins. The alkali (i.e., KOH or NaOH) can be present in the resin during manufacture or, more usually, post added to resin as KOH or NaOH preferably in aqueous solution of suitable strength. The alkalinity of the resin is expressed specifically by the molar ratio of alkali:phenol in the resin. According to the invention, the molar ratio of alkali:phenol is in the range of from 0.2:1 to 1.2:1. At alkali:phenol molar ratios less than 0.2:1 the speed of cure and product strength are much reduced. The reasons for this are not entirely clear but it seems probable that at such low ratios the resin tends to be insoluble or precipitates from solution during curing. Also we believe that a relatively high alkali:phenol molar ratio increases the concentration of phenolate type anions, which enhances the activity of the resin to curing by crosslinking. Alkali:phenol molar ratios higher than 1.2:1 are not used because the excess alkali makes the resins hazardous to handle. Furthermore, such high amounts of alkali tend to inhibit curing by oversolubilizing the resin and/or by reducing the effect of ester catalysis.

The resole resins have a formaldehyde:phenol molar ratio of from 1.2:1 to 2.6:1. Molar ratios lower than 1.2:1 are not used in the present invention because lower strengths are obtained in use. Molar ratios higher than 2.6:1 are not used because they may give rise to resins of too low a molecular weight or which may contain undesirably high levels of unreacted formaldehyde.

A silane is preferably included in the foundry moulding compositions of the invention to improve product strength. The use of such silanes is well known in the foundry binder art. Preferably, the silane used in the present invention is gamma-aminopropyltriethoxy silane. When used, the silane will typically be incorporated in the compositions in an amount of from 0.05% to 3.0% by weight based on the weight of the resin solution. Amounts of silane as low as 0.05% by weight based on the weight of the resin solution provide a significant improvement in strength of the foundry mould or core. Amounts of silane in excess of 3% by weight based on the weight of the resin solution would not be used normally because of the relatively high cost of such materials. Furthermore, because the preferred silane for use in the present invention (i.e., gammaaminopropyltriethoxysilane) contains nitrogen, the use of excess amounts of such silane may increase the risk of pinholing defects due to nitrogen in metal castings produced using foundry moulds and cores prepared from the composition of the invention.

As mentioned previously, according to one mode of carrying out the present invention, at least one liquid organic ester may be incorporated into the composition to catalyze the curing of the phenolic resole resin. The term "organic ester" as used herein includes lactones and organic carbonates, as well as carboxylate esters. Suitable liquid esters for this purpose have been described in U.S. Pat. No. 4,426,467, U.S. Pat. No. 4,474,904 and U.S. Pat. No. 4,468,359 (Re. 32,720), and include, for example, low molecular weight lactones having from 3 to 6 carbon atoms, esters of short and medium chain (i.e., 1 to 10 carbon) alkyl mono- or polyhydric alcohol with short or medium chain (i.e., 1 to 10 carbon) carboxylic acids, and carbonate esters. Specific examples of some preferred ester curing agents useful in the present invention are gamma-butyrolactone, propiolactone, caprolactone, valerolactone, glyceryl triacetate (triacetin), glycerol diacetate (diacetin), ethylene glycol diacetate, propylene carbonate, propylene glycol diacetate, alpha-butylene glycol diacetate, and mixtures of two or more of these.

The amount of ester catalyst used according to this mode of carrying out the invention will typically in the range of from 10% to 110% by weight based on the weight of the resin solution. The optimum amount in any case will, of course, depend on the ester chosen and the properties of the resin used.

When producing foundry moulds or cores using a composition containing a liquid organic ester, the components of the composition may be mixed in any order, provided that sufficient mixing is carried out to ensure good distribution of the carbonifiable material throughout the mixture. Distribution of the carbonifiable material may be facilitated by forming a premix of the carbonifiable material with the liquid ester, the phenolic resole resin solution and, if used, a silane, prior to adding to the granular refractory material. Immediately after mixing all of the components of the composition together, the resulting mixture is discharged into a core box or pattern mould and allowed to harden.

According to another mode of carrying out the present invention, a curable foundry moulding composition comprising a mixture of granular refractory material, aqueous phenol-formaldehyde resole resin solution, carbonifiable material and, if used, a silane, is prepared and formed into the desired shape, after which it is hardened by being subjected to gas curing using a 1-3 carbon alkyl formate. The components of the composition may be mixed together in any order. For instance, the carbonifiable and the granular refractory material may be premixed prior to mixing with the phenolic resole resin solution. It is also possible to add the carbonifiable material to the other components of the composition for mixing as a solution or dispersion in an organic fluid carrier, for example, as a solution in an organic solvent such as solvent naphtha. Alternatively, the carbonifiable material may be premixed with the aqueous phenolic resole resin solution to give a premix which can be added to and mixed with the granular refractory material. After mixing all of the components of the composition together, the mix may be formed into the desired shape, typically by being discharged into a vented corebox or pattern mould, and is then contacted with the vapor or droplets of a 1-3 carbon alkyl formate, preferably methyl formate.

The technique of gas curing alkaline phenolformaldehyde resin-containing compositions, in the production of foundry moulds and cores, is described in U.S. Pat.

No. 4,468,359 (Re. 32,720). The alkyl formate curing catalyst will not usually be used as a pure vapor, but as a vapor or aerosol in an inert carrier gas. By "inert carrier gas", we mean a gas which does not react with the formate catalyst or have an adverse effect on the curing reaction or the properties of the product. Suitable examples include air, nitrogen or carbon dioxide.

The gassing catalyst is a $C_1$ to $C_3$ alkyl formate preferably dispersed in a carrier gas as vapor or as an aerosol. Other esters e.g., formate esters of higher alcohols such as butyl formate, and esters of $C_1$ to $C_3$ alcohols with higher carboxylic acid such as methyl and ethyl acetates, are not effective as gassing catalysts. Methyl formate is significantly more active as a catalyst than ethyl formate which is better than the propyl formates. The reasons for the catalytic activity of the $C_1$ to $C_3$ alkyl formates and, within this group, the marked superiority of methyl formate, are not clear.

The relative volatility of these compounds enables their use as gassing catalysts. This is especially true of methyl formate which is a volatile liquid having a boiling point at atmospheric pressure of 31.5.C. At ambient temperatures (below 31.5° C.), typically 31.5° C. to 25° C., it is sufficiently volatile that passing carrier gas through liquid methyl formate (maintained at ambient temperature) gives a concentration of methyl formate vapor in the carrier gas sufficient to act as catalyst to cure the binder.

Ethyl formate and the propyl formates are less volatile than the methyl ester, having boiling points in the range 54° C. to 82° C. at atmospheric pressure. In order to entrain sufficient of these esters in the gas phase to enable effective catalysis, we have found it appropriate to heat these esters to near boiling point and use a stream of carrier gas preheated to about 100° C. or so.

An alternative to true vaporization is to form an aerosol in the carrier gas. Methyl formate is so volatile as to make this impractical. When using ethyl and propyl formates, it is desirable to preheat them to enhance even distribution in the core or mould during gassing.

As indicated above, methyl formate is the most active catalyst and, by virtue of its volatility, is the easiest to use. Accordingly, the use of methyl formate in a stream of inert carrier gas as the gassing catalyst forms a particularly preferred embodiment of this invention. A further practical advantage of these formate esters, especially methyl formate, is their relatively low toxicity and the fact that their toxicity is well understood.

The time required for adequate gassing depends on the size and complexity of the core or mould and on the particular resin used It can be as short as 0.1 secs but more usually is in the range 1 sec to 1 min. Longer times, e.g up to 5 mins, can be used if desired or for large moulds or cores.

After gassing, the core or mould is stripped from the box. Sufficient time must elapse to permit the strength of the mould or core to build up to permit stripping without damage Production speed can be enhanced by purging the mould or core box with a suitable inert gas such as air, which removes residual catalyst vapor and water and other products of the curing reaction.

EXPERIMENTAL METHODS

1. General Procedure for the Manufacture of a Phenol-Formaldehyde Resin Solution 100% Phenol was dissolved in 50% aqueous KOH in an amount corresponding to the desired KOH:phenol molar ratio (from 0.5 to 1.2). The solution was heated to reflux under reduced pressure at 75° C. and 50% aqueous formaldehyde was added slowly, while maintaining reflux at 75° C., in an amount corresponding to a desired formaldehyde:phenol molar ratio (1.6, 1.8 or 2.0). The reaction mixture was maintained under vacuum reflux at 75° C. until it attained a predetermined viscosity. If desired, the solids content can be adjusted by distillation, but this is not usually necessary. Minor amounts of KOH solution may be added to adjust the KOH:phenol molar ratio. The resin solution was cooled to 40° C. and 0.4% by weight of the resin solution of gamma-aminopropyltriethoxy silane was added

2. Testing of Resins (a) Viscosity measured using an Ostwald (U-tube) viscometer at 25° C.

(b) Solids content measured by heating a weighed sample (2.0±0.1 g) in an air circulating oven for 3 hours at 100° C.

3. Preparation of Styrenated Phenol (SP)

1 mol of phenol was reacted with 2.2 moles of styrene in the presence of 0.5% of paratoluene sulphonic acid based on the phenol, until the temperature rose to 135° C. The reactants were held at this temperature for 15 minutes, then neutralized with sodium carbonate solution, washed with twice the phenol weight of water; half the phenol weight of toluene was added, the mix agitated, and then allowed to settle. The top water layer was drawn off, the toluene was distilled off, and the product filtered to ensure clarity. A yield of 338% by weight basis of the original phenol content was obtained. The product had a refractive index of 1.603 and a viscosity of 5000 cP at 25° C. (as measured by a Brookfield viscometer, model RVF, spindle 4, speed 20 rpm, at 25° C.).

Using the "Bindernagel Test", the styrenated phenol product obtained above was found to yield 51.1% lustrous carbon.

EXAMPLE 1

I. Preparation of An Aqueous Solution of a KOH Catalyzed Phenol-Formaldehyde Resin - RESIN A An aqueous solution of a KOH-catalyzed phenol-formaldehyde resin was prepared according to the procedure described above under the heading "EXPERIMENTAL METHODS. 1. General Procedure for the Manufacture of Phenol-Formaldehyde Resin Solution." The characteristics of the aqueous resin solution produced (hereafter call "RESIN A") are set out in Table 1 below.

TABLE 1

| Characteristics of Resin A | |
|---|---|
| formaldehyde:phenol molar ratio | = 2.0:1.0 |
| KOH:phenol molar ratio | = 0.8:1.0 |
| % KOH (by weight based on the weight of the KOH-catalyzed resin) | = 12.8% |
| solids content (by weight) | = 62% |
| viscosity (at 25° C.) | = 95 c St. |
| specific gravity | = 1.24 |
| *calculated viscosity | = 118 cP |

*Viscosity (stokes) = viscosity (poises)/specific gravity

II. Preparation and Curing of Foundry Cores According to an Embodiment of the Invention in Which the Resin is Cured With a Gaseous Ester 100 Parts by weight of AFS.50 silica sand and 0.3 parts by weight of styrenated phenol (prepared according to the procedure described above under the heading "EXPERIMENTAL METHODS. 3. Preparation of Styrenated Phenol (SP).") were charged to a batch mixture and mixed for 1 minute. 1.8 Parts by weight of RESIN A (see above) were then added to the mixture of silica sand and styrenated phenol and mixing was continued for an additional minute. Portions of the resulting mixture were discharged into several vented core boxes. These were then gassed with a methyl formate/air mixture to cure the resin in the mixture to produce foundry cores for testing.

III. Preparation and Curing of Foundry Cores for Comparison (A) Foundry cores similar to those made according to II above were made from a sand/resin mixture identical to that used in II above except that the styrenated phenol was omitted from the mixture.

(B) To some of the cores produced in (A) above a blacking wash comprising a suspension of carbon in isopropanol was applied.

(C) Foundry cores similar to those produced in II and in (A) above were made according to the known polyurethane cold box process disclosed in GB 1,190,644 according to which a benzylic ether-type phenolic resin dissolved in a mixture of solvents is mixed with methylene diphenyl diisocyanate on the sand and the core is induced to harden by passing triethylamine vapor/air mixture through the sand.

IV. Preparation of Castings From the Foundry Cores

The cores obtained according to II, III (A), III (B) and III (C) above were assembled in green sand moulds and cast with grey iron. The surface finishes of the various castings produced were assessed and the results are given below in Table 2.

TABLE 2

| TYPE OF FOUNDRY MOULDING COMPOSITION USED | SURFACE FINISH OF CASTING |
|---|---|
| 1. Using resin without styrenated phenol additive. (III(A)) | Very poor - rough |
| 2. Blacked cores made from resin without styrenated phenol additive. (III (B)) | Good surface finish but some signs of brush marks. |
| 3. Polyurethane Cold Box (III (C)) | Good surface finish; no brush marks |
| 4. Resin containing styrenated phenol additive. (II) | Excellent surface finish - very smooth |

EXAMPLES 2 TO 5

I. Preparation of an Aqueous Solution of a KOH Catalyzed Phenol-Formaldehyde Resin - RESIN B Using the procedure described above under the heading "EXPERIMENTAL METHODS. 1. General Procedure for the Manufacture of Phenol Formaldehyde Resin Solution", an aqueous solution of a KOH-catalyzed phenolformaldehyde resin (RESIN B) was prepared. The characteristics of RESIN B are shown below:

| | | |
|---|---|---|
| RESIN B: | Formaldehyde:Phenol | = 1.7:1 |
| | KOH:Phenol | = 0.64:1 |
| | % KOH | = 11.0% |
| | Solids content | = 53% |
| | Viscosity | = 120 cSt at 25° C. |
| | specific gravity | = 1.22 |
| | *calculated viscosity | = 146 cP |

*Viscosity (stokes) = viscosity (poises)/specific gravity

II. Determination of Lustrous Carbon Evolution of Various Materials

Using the "Bindernagel Test", the lustrous carbon evolution of RESIN B, three carbonifiable materials and Ester C (comprising 65% by weight ethylene glycol diacetate, 10% by weight propylene carbonate and 25% by weight butyrolactone) were determined. The results are shown in Table 3.

TABLE 3

| Material | % lustrous carbon | % residue |
|---|---|---|
| Resin B | 0.0–0.1 | 30 |
| Ester C | 31.5–33.4 | 0.2 |
| Actral 400[1] | 59.8–63.2 | 8 |
| Naphthalene | 37.5–41.1 | 9 |
| Piccolastic A5[2] | 47.4–54.5 | 16 |

[1]Actral 400 (Trademark of Esso Chemical) is a reaction product of tetrahydronaphthalene and styrene.
[2]"Piccolastic" is a Registered Trademark of Hercules Powder Corporation. Piccolastic A5 is a low MW polystyrene resin.

III. Preparation and Testing of Cores

Compositions comprising sand (Chelford 50), Resin B, Ester C and a carbonifiable material were prepared by mixing the sand with 1.5% by weight (based on sand) of Resin B and then an amount of Ester C plus carbonifiable material (equal parts by weight) or Ester C alone (comparative) was mixed thoroughly with the resin/sand mixture. The mixtures were then quickly discharged into test moulds. Specifically, each mixture was made as follows:

1 kg of the selected sand was charged to a Fordath laboratory coremixer. The ester catalyst containing aromatic hydrocarbon was added and mixed for 1 minute and the resin solution was then added. Mixing was continued for 1 minute and the mixture then quickly discharged into the test moulds. One sample of each mixture was rammed into a waxed paper cup which was squeezed by hand to assess the bench life and when setting had occurred. Other samples of each mixture were formed into 5×5 ca cylindrical test cores by the standard method recommend by the I.B.F. working party P. The test cores were placed in a standard atmosphere, 20° C., 50% relative humidity and samples were tested for compression strength 1 h, 2 h, 4 h and 24 h after manufacture. All compression test cores were made within 2 minutes of discharging the mix.

The compositions and their compressive strengths are shown in Table 4.

TABLE 4

| EXAMPLE NO. | 2 | 3 | 4 | 5 |
|---|---|---|---|---|
| Carbonifiable material | Actral 400 | Naphthalene | Piccolastic A5 | None |
| Amount of above (% by weight of | 18 | 18 | 18 | 0 |

TABLE 4-continued

| EXAMPLE NO. | 2 | 3 | 4 | 5 |
|---|---|---|---|---|
| resin solution) | | | | |
| Amount of Ester C (% by weight of resin solution) | 18 | 18 | 18 | 18 |
| Bench life (min) | 14 | 14 | 9 | 14 |
| Set time (min) | 25 | 25 | 13 | 23 |
| Compressive strength | | | | |
| after 1h | 1235 | 1380 | 1480 | 1380 |
| after 2h | 2195 | 1998 | 2420 | 2120 |
| after 3h | 3305 | 3060 | 3625 | 3405 |
| after 24h | 4440 | 4315 | 4935 | 4515 |

EXAMPLE 6

In a foundry trial, a mixture of Wetten 55 silica sand comprising 60% sand reclaimed on a Richards attrition plant and 40% new, was mixed with 1.7% on the weight of the sand of Resin B, prepared as above and 23%, based on the weight of resin, of Ester C, was used to prepare a series of horizontally split moulds for the casting of a 10 kg pulley wheel in grey iron. Some of the moulds were left unblacked and others were blacked using a wash comprising ground oil coke suspended in isopropanol.

A further series of similar moulds was made using 46% on the weight of the resin, of an equal mixture of Ester C and Piccolastic A5, in place of the 23% of Ester C alone. (Piccolastic is a Registered Trademark of Hercules Powder Corporation. Piccolastic A5 is a low molecular weight polystyrene resin).

The moulds were assembled and poured with grey iron at a temperature of 1320° C. After cooling for 24 hours, the castings were knocked out and the surface finish observed.

The castings made in the unblacked moulds and bonded using no hydrocarbon additive were rough in surface finish and showed a significant number of sand grains adhering to the metal surface. The castings made with the blacked moulds were smooth in finish but showed brush marks and other imperfections introduced through coating.

The castings made from moulds containing the carbonifiable material were smooth and free from adhering sand grains.

EXAMPLES 7 TO 11

Mixtures were prepared as in Examples 2–5, except that the curing agent compositions used were as follows, where the styrenated phenol was that prepared according to the procedure described above under the heading "EXPERIMENTAL METHODS. 3. Preparation of Styrenated Phenol."

| Example No. | Material | % on resin |
|---|---|---|
| 7 | Ester C | 18 |
| | Styrenated phenol | 18 |
| 8 | Ester C | 20 |
| | Styrenated phenol | 20 |
| 9 | Ester C | 18 |
| | Styrenated phenol | 12 |
| 10 | Ester C | 24 |
| | Styrenated phenol | 16 |

-continued

| Example No. | Material | % on resin |
|---|---|---|
| 11 | Ester C | 18 |

| EXAMPLE NO. | 7 | 8 | 9 | 10 | 11-Comparative |
|---|---|---|---|---|---|
| Bench life (min) | 14 | 14 | 13 | 13 | 12 |
| Set time (min) | 23 | 22 | 20 | 18 | 19 |
| Compressive strength: | | | | | |
| after 1 hr | 1185 | 1185 | 1235 | 1380 | 1330 |
| after 2 hrs | 1825 | 1875 | 2095 | 2295 | 2170 |
| after 4 hrs | 2392 | 2515 | 2565 | 2985 | 2985 |
| after 24 hrs | 4045 | 4120 | 4340 | 4465 | 4415 |

While the invention has been described in connection with specific embodiments thereof, it will be understood that it is capable of further modifications. This application is intended to cover any variations, uses or adaptions of the invention following, in general, the principles of this invention, and including such departures from the present disclosure as come within known and customary practice within the art to which the invention pertains.

What is claimed is:

1. A method of making a foundry mould shape or core shape comprising:
   (1) preparing a composition;
   (2) forming the product of step (1) into a shape; and
   (3) allowing said shape to harden
   wherein said composition comprises a mixture of:
   (a) a granular refractory material;
   (b) from 0.25% to 8% by weight based on the weight of the granular refractory material of an aqueous solution having a solids content of 25% to 75% by weight of an alkali phenolformaldehyde resole resin having a formaldehyde:phenol molar ratio in the range of from 1.2:1 to 2.6:1 and an alkali:phenol molar ratio in the range of from 0.2:1 to 1.2:1, said aqueous solution of resole resin having a viscosity in the range of from 20 cP to 1000 cP at 25° C.;
   (c) a carbonifiable material capable of evolving at least 20% based on its original weight of lustrous carbon, as measured by the Bindernagel test;
   (d) an amount effect to catalyze the curing of the resin of at least one liquid organic ester; and
   wherein said carbonifiable material comprises styrenated phenol.

2. A method of making a foundry mould or core shape comprising:
   (1) forming a mixture of
   (a) granular refractory material;
   (b) aqueous solution of alkali phenolformaldehyde resole resin; and
   (c) carbonifiable material capable of evolving 20% lustrous carbon based on its original weight of lustrous carbon as measured by the Bindernagel test,
   wherein said carbonifiable material comprises styrenated phenol;
   wherein the amount of said aqueous solution of resole resin is 0.25% to 8% by weight based on the weight of said granular refractory material;
   wherein said aqueous solution of resole resin has a solids content of 25% to 75% by weight;

wherein said resole resin has a formaldehyde to phenol molar ratio in the range of from about 1.2:1 to about 2.6:1;

wherein said aqueous solution of resole resin has an alkali to phenol molar ratio in the range of from 0.2:1 to about 1.2:1;

and wherein said aqueous resole solution has a viscosity in the range of from about 20 cP to about 1000 cP at 25° C.;

(2) forming the product of step (1) into a desired shape; and (3) gassing the formed mixture in said shape with a curing agent selected from the group consisting of methyl formate, ethyl formate, propyl formate, isopropyl formate, and mixtures thereof, to cure said resin.

3. The method of claim 2 wherein said alkali resole is selected from the group consisting of sodium resoles, potassium resoles, and mixtures thereof.

4. The method of claim 2 wherein said curing agent comprises methyl formate.

5. The method of claim 2 wherein said curing agent comprises methyl formate.

6. The method of claim 2 wherein the amount of said carbonifiable material is in the range of from about 10% to about 30% based on the weight of said aqueous solution of resin.

7. The method of claim 2 wherein the amount of said carbonifiable material is from 0.5% to 165% by weight of said aqueous solution of resin.

8. The method of claim 2 wherein said aqueous solution of resin has a resin solids content of about 60% and a viscosity of about 200 cP.

9. The method of claim 2 wherein said curing compound in liquid form is combined with a heated stream of inert gas to vaporize said curing compound before being brought in contact with said shape.

10. The method of claim 2 wherein said curing agent that is brought in contact with said shape is dispersed in a carrier gas as a vapor or as an aerosol and said carrier gas is selected from the group consisting of air, nitrogen, carbon dioxide, and mixtures thereof.

11. The method of claim 2 wherein said carbonifiable material is in solution or is dispersed in an organic fluid carrier.

12. The method of claim 11 wherein said carbonifiable material is in a solution in a carrier comprising the solvent naphtha.

* * * * *